US008009521B2

(12) United States Patent
Wu

(10) Patent No.: US 8,009,521 B2
(45) Date of Patent: Aug. 30, 2011

(54) WRISTWATCH WITH CONCAVE GLASS LENS AND DIAL

(76) Inventor: Kun-Chi Wu, Princeton, NJ (US)

( * ) Notice: Subject to any disclaimer, the term of this patent is extended or adjusted under 35 U.S.C. 154(b) by 0 days.

(21) Appl. No.: 12/539,020

(22) Filed: Aug. 11, 2009

(65) Prior Publication Data

US 2010/0039905 A1 Feb. 18, 2010

Related U.S. Application Data

(60) Provisional application No. 61/088,369, filed on Aug. 13, 2008.

(51) Int. Cl.
*G04B 19/04* (2006.01)

(52) U.S. Cl. ..... 368/228; 368/232

(58) Field of Classification Search ..... 368/228, 368/232–237, 238
See application file for complete search history.

(56) References Cited

U.S. PATENT DOCUMENTS

| | | | | | |
|---|---|---|---|---|---|
| 4,692,033 | A * | 9/1987 | Mock et al. | ..... | 368/280 |
| 4,853,910 | A * | 8/1989 | Mock | ..... | 368/300 |
| 4,956,830 | A * | 9/1990 | Mock et al. | ..... | 368/280 |
| 5,065,374 | A * | 11/1991 | Soder et al. | ..... | 368/280 |
| 5,706,255 | A * | 1/1998 | McKay | ..... | 368/10 |
| 5,883,860 | A * | 3/1999 | McKay | ..... | 368/10 |
| 6,480,441 | B1 * | 11/2002 | McKay | ..... | 368/10 |
| 6,950,374 | B2 * | 9/2005 | McKay | ..... | 368/10 |
| 7,388,813 | B2 * | 6/2008 | Su | ..... | 368/79 |

* cited by examiner

*Primary Examiner* — Sean Kayes

(57) ABSTRACT

A wristwatch that includes a concave lens and concave dial contained within a bezel and housing. The concave shape of the lens causes the upper most surface of the wristwatch to be the bezel, so the upper surface of the lens cannot be scratch if the user places the watch face down on a surface. The concave shape of the dial causes an increase in surface area for time marking indicia on the dial face. This effect combines with the concave angle of the lens to increase the appearance of the indicia and reduce glare.

6 Claims, 4 Drawing Sheets

WRISTWATCH WITH CONCAVE GLASS LENS AND DIAL

This application claims priority from and the benefit of U.S. provisional patent application Ser. No. 61/088,369, filed Aug. 13, 2008, entitled Wristwatch with a Concave Lens, all of which are incorporated herein by reference.

FIELD OF INVENTION

The present invention generally relates to wristwatch technology and more specifically to a watch that provides for an increase in the ability for the user to see the time markings, further reduces glare, and is integrally scratch resistant.

BACKGROUND OF THE INVENTION

It is well known that people have needed the ability to accurately tell time. As human mobility has increased so has the need to have a portable source that can keep time. Originally, the pocket watch was invented that mainly consisted of watch gears surrounded in a metal casing. The metal casing protected the glass face of the pocket watch from accidental scratching or damage. The pocket watch has been slowly replaced by wristwatches, which provided an easier mobility and easy since they were not carried in the users pocket. As a consequence of the new ease of mobility created by the wristwatch, the damage to the class covering the watch hands and gears has become more prevalent. Therefore, it has become advantageous to for wristwatches to be designed for scratch-resistance.

One of the main methods to achieve scratch-resistance is by using scratch resistant glass or crystal to cover the watch face. Scratch-resistant substances have had many applications and their use in watches has great advantages since the watch lens is not significantly more difficult to be damaged. However, the additional cost of a scratch-resistant glass watch makes the use of such glass less desirable, in addition to that the glass is scratch-resistant and not scratch proof. The use of plastic as a watch cover has been used as well. Whereas, this change in material addresses the cost factor, it is rarely as clear as glass or crystal and does not provide the aesthetic appeal many watch owners' desire. In addition, plastic is usually easy to scratch, but more difficult to crack than its glass counterpart.

Another method of scratch resistance has been by using a guard that surrounds the watch face. This guard prevents the user from scratching the glass face of the watch when laying it face down. These guards, however, limit the viewing angle of the watch face and make time reading somewhat difficult.

SUMMARY OF THE INVENTION

The present invention provides a scratch-resistant glass wristwatch that includes a concave glass lens. In one general aspect, the concave glass lens that sets upon the upper rim of a watch housing. The concave dial, of similar curvature, is between the lower surface of the watch housing and the concave glass lens. The watch hands follow the similar curve as the concave dial and concave glass lens. The curved crystal cover has enough curve in it in order to keep it inside the bezel an appropriate enough amount that when the watch is placed face down there is no part of the crystal cover that makes contact with the surface the watch was placed upon.

The concave lens is held in place by a collar or bezel that attaches to the watch housing. The concave lens dimples in beyond the outer surface of the bezel, whereby making the watch integrally scratch resistant since no surface of the lens extends beyond or is even with the outermost part of the watch. In addition, the combination of the concave lens and concave dial provides for both the increase in surface area for dial indicia and less light refraction, whereby reducing glare and increasing the user's ability to read the time indicia because the area for the indicia to be is made larger by the dials concave shape. When the curvature of the dial and the lens are the same, it creates, as stated above, the increased visibility of the larger indicia, when compared to a watch with a flat lens and dial.

BRIEF DESCRIPTION OF THE DRAWINGS

These and other features and advantages of the present invention will be more fully disclosed in, or rendered obvious by the following detailed description of preferred embodiments of the invention, which are to be considered together with the accompanying drawings wherein like numbers refer to like parts, and further wherein.

DETAILED DESCRIPTION OF THE PREFERRED EMBODIMENTS

Figure 1:
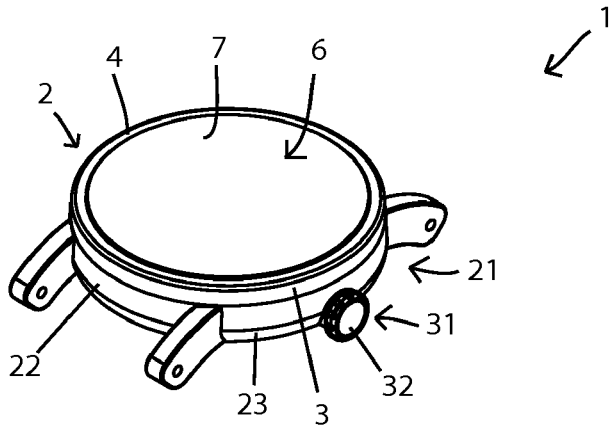
FIG. 1 is a front perspective view of a wristwatch with concave glass lens in accordance with the present invention.

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. In the claims, means-plus-function clauses, if used, are intended to cover the structures described, suggested, or rendered obvious by the written description or drawings for performing the recited function, including not only structural equivalents but also equivalent structures.

Figure 2:
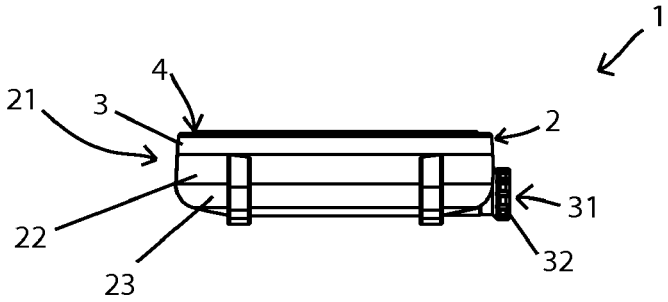
FIG. 2 is a front view of the wristwatch with concave glass lens as shown in FIG. 1.
Figure 3:
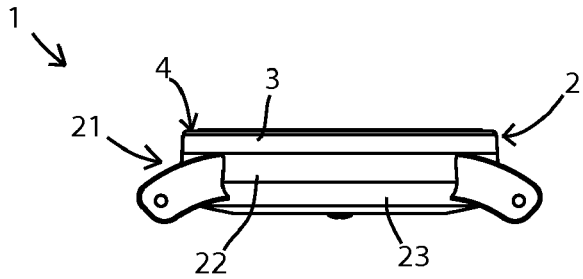
FIG. 3 is a side view of the wristwatch with concave glass lens as shown in FIG. 1.
Figure 4:
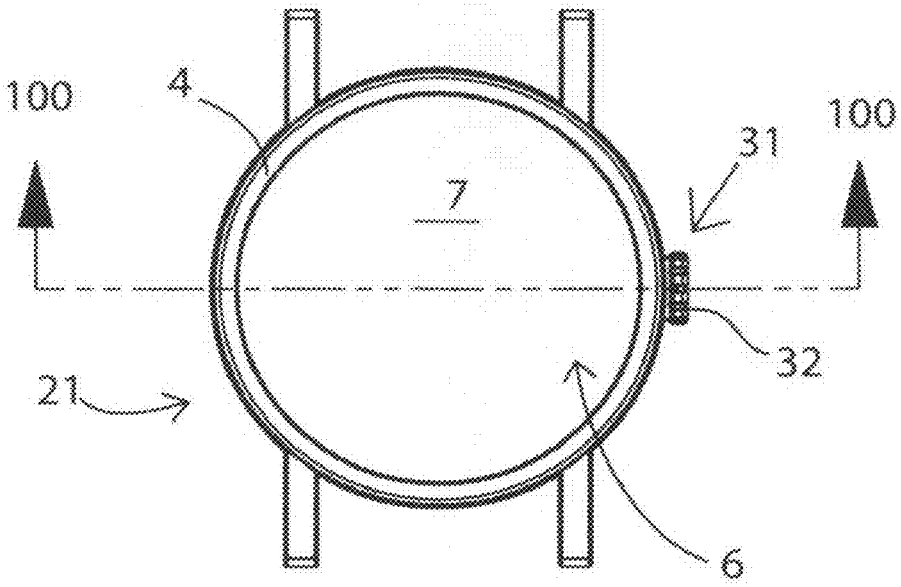
FIG. 4 is a top view of the wristwatch with concave glass lens as shown in FIG. 1.
Figure 5:
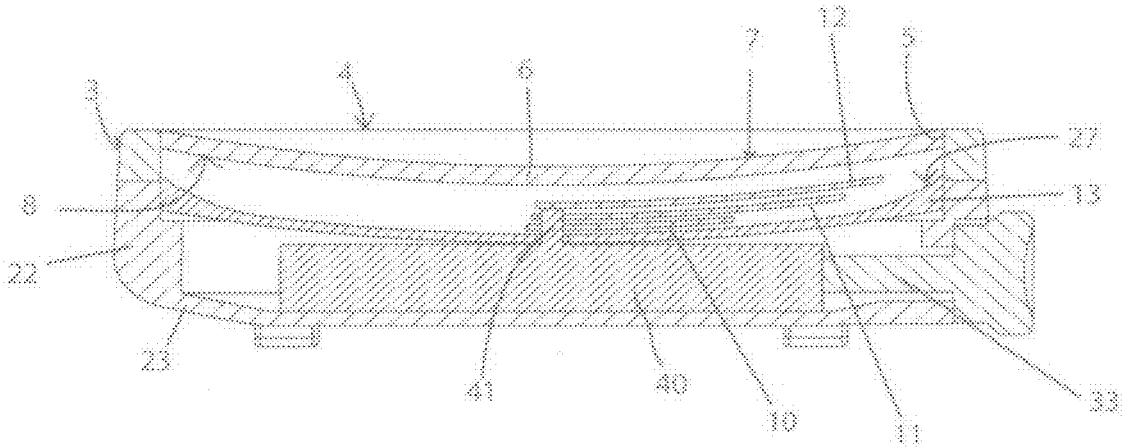
FIG. 5 is a cross-sectional view of the wristwatch with concave glass lens shown in FIG. 1, as taken along lines 100-100 in FIG. 4.
Figure 6:
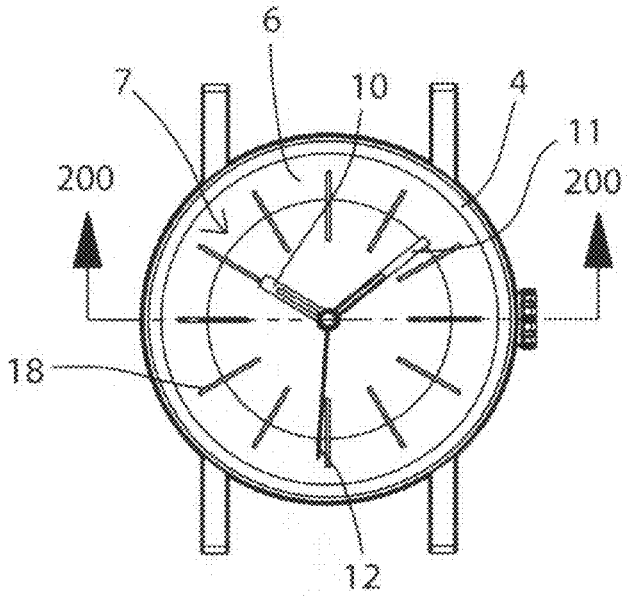
FIG. 6 is top view of the wristwatch with concave glass lens in accordance with the present invention, without concave lens.
Figure 7:
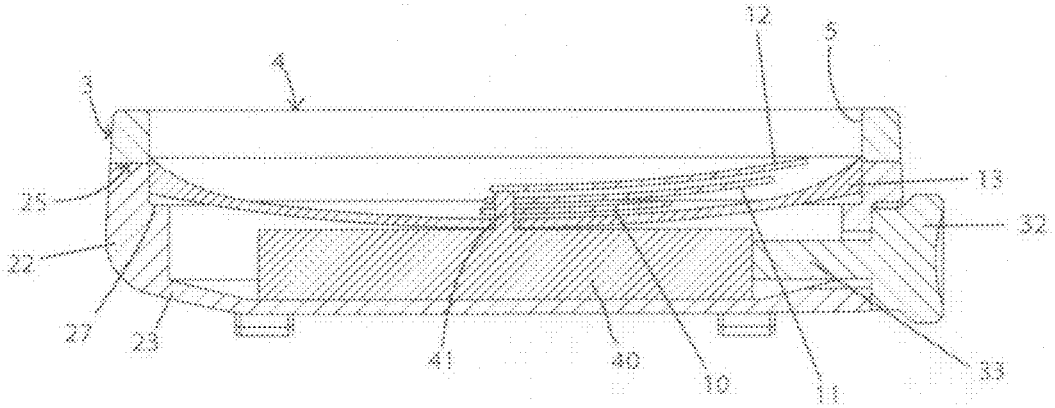
FIG. 7 is a cross sectional view of the wristwatch with concave glass lens as shown in FIG. 6, as taken along lines 200-200 in FIG. 6.
Figure 8:
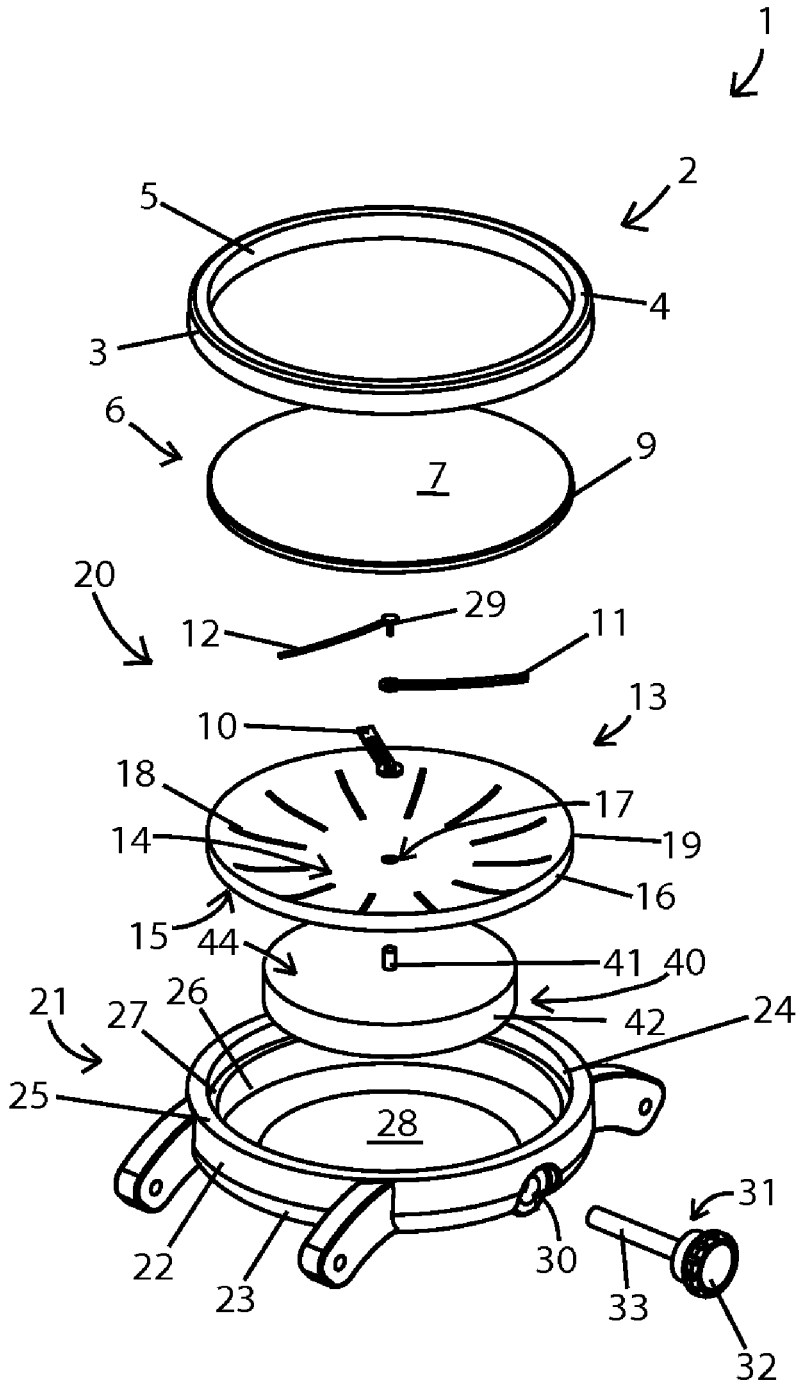
FIG. 8 is an exploded perspective view of the wristwatch with concave glass lens as shown in FIG. 6, with concave lens.

Referring to FIGS. 1-8, a wristwatch 1 that is integrally scratch-resistant and provides for easy indicia visibility, includes bezel 2, concave lens 6, concave dial 13, housing 21, and winder 31. Housing 21 having circular bottom wall 23 protruding inwardly from the lower end of annular outer wall 22 creates base surface 28. Circular rim wall 25 protrudes inwardly from the upper end of annular outer wall 22 before extending downward becoming annular inner wall 24. Circular platform wall 27 extending radially inwardly from the outer surface of annular inner wall 24. Annular lower wall 26 is rounded and protrudes downwardly from the outer end of circular platform wall 27 before forming base surface 28.

Gearbox 40 including upper surface extending radially inward from the upper end of annular wall 42 includes drive post 41 protruding upward from upper surface 44. Base surface 43 (not shown) protrudes radially inward from the lower end of annular 42 creating gear box 40, which contains the mechanisms in order to keep proper time. Gearbox 40 is held center on base surface 28 by the annular lower wall 26. Cylindrical rod 33 of winder 31 is inserted through opening 30 of outer annular wall 22 in housing 21. Cylindrical rod 33 enters into an opening (not shown) in the annular wall 42 of gear box 40 permitting the user to either wind the watch or set the time via the internal mechanisms. A grip wheel 32 at the distal end of cylindrical rod 33 allows the user to rotate cylindrical rod 33 in order to set the time, date, spring, etc of wristwatch 1.

Concave dial 13 includes annular edge wall 16 having an upper surface 14 and lower surface 15 projects inwardly from dial edges 19 forming pinhole 17 at the exact center. Drive post 41 of gear box 40 inserts into pinhole 17. Pinhole 17 has a diameter sized to permit drive post 41 being of an outer diameter to fit just within pinhole 17. Annular edge wall 16 having a diameter and circumference designed to fit just within annular inner wall 24 of outer wall 22 and set upon circular platform wall 27. Platform surface 27 can be angled slightly downward to conform to the curvature of concave dial 13. In this embodiment, there are three time indicating hands 20. Hour hand 10 and minute hand 11 each having an opening designed to fit around the outside diameter drive post 41 above the upper surface 14 of the concave dial 6. Second hand 12 includes a pin 29 that corresponds to the opening in the end of drive post 41 secures the hour hand 10 and minute hand 11 to gearbox 40. Hour hand 10, minute hand 11, and second hand 12 are all formed to align with the concave shape of concave dial 13 permitting the hands to rotate about drive post 41 without obstruction. Indicia 18 are displayed, through any means well known throughout the art, upon the upper surface 14 to indicate the time. The curvature of the concave dial 13 allows the indicia 18 to be printed larger than a flat dial face due to the natural increase in the size of upper surface 14. The matching curvature to the hour hand 10, minute hand 11, and second hand 12 permits an extension of the length of the hands. The increased size of the hands and the indicia 18 allow the user a larger and therefore easier reading surface.

Concave lens 6 having an annular edge wall 9, an upper surface 7 and a lower surface 8 is formed to correlate to the curvature of concave dial 13. Annular edge wall 9 having a diameter allowing it to fit within annular outer wall 22 and upon circular rim wall 25. Circular rim wall 25 can have an angle corresponding with the curvature of concave lens 6 allowing the concave lens to properly nestle and be held in place. Bezel 2 includes circular lip wall 4 extending inwardly from the upper end of outer annular wall 3. Inner annular wall 5 extends downward from the inner end of circular lip wall 4. Outer annular wall 3 secures bezel 2 to annular outer wall 22 whereby securing the annular edge wall 9 of concave lens 6 between circular lip wall 4 and circular rim wall 25.

It is to be understood that the present invention is by no means limited to the particular constructions herein disclosed and shown in the drawings, but also comprises any modifications or equivalents within the scope of the claims.

What is claimed is:

1. A scratch-resistant wristwatch comprising
- a housing having an annular outer wall and a circular bottom wall;
- a gearbox set within said housing having a drive post;
- a concave dial that rests within said housing;
- a concave shaped lens that rest within said housing;
- time indicating, hands connected to said gear box;
- a bezel connected to said annular outer wall of said housing;
- said concave dial and concave shaped lens are of the same curvature;
- a circular rim wall is formed from a upper end said outer wall of said housing and is angled as to match the curvature of said concave shaped lens; and
- said concave lens includes an edge wall that rests upon said upper rim wall permitting said upper surface of said concave lens to be recessed within said housing.

2. A wristwatch according to claim 1 wherein said bezel connects to said housing trapping said concave lens within said housing causing said upper surface of said concave lens to not be contacted when set down upon the lip wall of said bezel.

3. A wristwatch according to claim 2 wherein indicia that display a clock face showing time are displayed on said upper surface of said concave dial.

4. A wristwatch according to claim 3 wherein said indicia are larger due to the curvature of said concave dial allowing for a larger surface area of said concave dial causing said indicia to be easier to read.

5. A wristwatch according to claim 4 wherein said time indicating hands are curved to correspond with the curvature of said concave lens and said concave dial.

6. An integrally scratch resistant wristwatch comprised of:
- a housing having an annular wall and a circular bottom wall with said bottom wall including a base surface;
- a circular rim wall projecting inwardly from an upper end of said annular outer wall;
- a gear box set atop said base surface including a drive post;
- a concave dial including an annular edge wall and a pinhole at the center that aligns with said drive post;
- indicia on said concave dial;
- an hour hand, a second hand, and a minute band having a curvature matching the concave dial secured to said drive post;
- an inner annular wall extending downward from the end of said circular rim wall;
- a circular platform wall formed at the lower end of said annular inner wall;
- a concave lens having an annular edge wall and an upper surface; and
- a bezel hazing a lip wall that permanently connects to said housing and capturing said concave lens beneath said bezel so all points on said upper surface of said concave lens are below the bezel.

* * * * *